US005135210A

United States Patent [19]

Michelson

[11] Patent Number: 5,135,210

[45] Date of Patent: Aug. 4, 1992

[54] SURGICAL ARMBOARD ATTACHMENT DEVICE

[76] Inventor: Gary K. Michelson, 438 Sherman Canal, Venice, Calif. 90291

[21] Appl. No.: 552,878

[22] Filed: Jul. 16, 1990

Related U.S. Application Data

[63] Continuation of Ser. No. 345,893, May 1, 1989, abandoned.

[51] Int. Cl.[5] ..... A61G 13/00

[52] U.S. Cl. ..... 5/658

[58] Field of Search ..... 269/322-328, 269/61, 75; 5/431, 437, 436; 248/286, 287, 284, 296, 298, 295.1; 403/59, 80; 128/20

[56] References Cited

U.S. PATENT DOCUMENTS

| | | | |
|---|---|---|---|
| 1,968,120 | 7/1934 | Barghausen et al. | 269/328 |
| 2,972,505 | 2/1961 | Weickgenannt | 269/328 |
| 3,124,328 | 3/1964 | Kortsch | 269/323 |
| 3,540,719 | 11/1970 | Romney | 269/328 |
| 3,614,085 | 10/1971 | Cunningham | 269/328 |
| 3,849,945 | 11/1974 | Lindzy | 269/75 |
| 4,583,725 | 4/1986 | Arnold | 269/328 |
| 4,796,846 | 1/1989 | Meier et al. | 269/328 |
| 4,807,864 | 2/1989 | Young | 269/328 |
| 4,840,363 | 6/1989 | McConnell | 269/328 |
| 4,858,903 | 8/1989 | Tari et al. | 269/328 |

FOREIGN PATENT DOCUMENTS

| | | | |
|---|---|---|---|
| 503763 | 5/1954 | Canada | 269/328 |
| 266973 | 3/1927 | United Kingdom | 269/328 |
| 814770 | 6/1959 | United Kingdom | 269/328 |
| 893770 | 4/1962 | United Kingdom | 269/323 |

*Primary Examiner*—Robert C. Watson
*Attorney, Agent, or Firm*—Lewis Anten

[57] ABSTRACT

An improved surgical armboard attachment device permitting enhanced adjustability of a conventional surgical armboard is disclosed. The attachment device permits adjustment of the armboard in three planes, and can be used as an adaptor to an existing armboard, or incorporated as a component of a new armboard structure.

13 Claims, 11 Drawing Sheets

SURGICAL ARMBOARD ATTACHMENT DEVICE

This is a continuation of application Ser. No. 07/345,893, filed on May 1, 1989, now abandoned.

BACKGROUND

All conventional surgical operating tables are equipped with standardized side rails for the purpose of accepting various accessories which are attached to the side rail of the operating table via a socket mechanism which is free to move along the rail. Armboards are also designed which attach directly to the side rails, without the use of sockets, such armboards having their own attachment mechanisms. A conventional surgical armboard is designed to allow the board to be adjustable, but only within the plane of the surface of the operating table. The only other motion possible with such an arrangement is the actual location of the armboard along the side rail.

As armboards are most frequently employed with the patient in the supine position (face up) they have proven in this regard generally acceptable. However, when the need arises to position the patient prone (face down) to perform posterior spinal surgery, then the armboards lack sufficient adjustability to be functionally acceptable. Since the armboards are in the same plane as the top surface of the table itself, then regardless of the angle of the board to the table, with the patient face down, the shoulders will be hyperabducted, hyperextended, and posteriorly displaced. This position is quite dangerous to the patient since it may cause either a compression or a tension injury to the very large bundle of nerves passing from the neck, beneath the shoulder, and the arm called the Brachial Plexus. As the patient is anesthetized and therefore unable to react, such neurological injuries occur frequently and with a known relationship to the duration of the positional insult. A second and equally significant cause of neurological injury is the high pressure applied to the ulnar nerve at the elbow caused by the unnatural position of the upper extremity induced by the conventional armboard.

PRIOR ART

A prior art socket for attachment to the side rails is shown in FIG. 1. A prior art armboard, directly attached to the operating table and having one degree of freedom is shown in FIG. 2.

U.S. Pat. No. 3,614,085 issued to Cunningham, Oct. 19, 1971, discloses an armboard for attachment to dental chairs or hospital tables that . . . "may be adjusted in two degrees of freedom.". The device requires the adjustment of three separate tightened clamps, such that a separate adjustment and then locking procedure is required for fixing the position of the armboard. Also, the multitude of separate adjustments and clamping must be performed in a tight space and with limited visibility as they occur beneath the board itself. Even then, rotation of the board about the longitudinal axis is not possible.

U.S. Pat. No. 4,390,011 issued to Evans, Jun. 28, 1983, discloses a surgical armrest to be used to support the surgeon's hands, not the patients arms. The armrest is adjustable only as to height and the angle of the inclination relative to the surgical table.

SUMMARY OF THE INVENTION

The present invention is a device specifically designed so as to allow a conventional surgical armboard to be used in conjunction with a conventional surgical socket, and thereby making the conventional armboard capable of nearly universal motion. The adaptor device attaches to the conventional surgical armboard attachment means without the need for any drilling, machining, or further modification.

The adaptor comprises a shaft at one end for fitting within the receptive opening of the conventional socket, and an armboard attaching member at the other end for attaching to the armboard by simulating the side rail of an operating table. The armboard itself may also be constructed so that it is formed integrally with the shaft.

Since the conventional armboard provides the mechanism for determining the angle of the armboard within the plane of the table, and since the socket mechanism can be placed on the side rail anywhere along the length of the table, then the adaptor device permits nearly universal positioning of the armboard within the range of desired function. Furthermore, whereas spinal surgery is frequently performed with the table itself in an inclined position, contrary to the prior art boards, the present invention allows for the independent positioning of the armboard regardless of the inclination of the table. Further, the present invention is actually capable of utilizing the table inclination to provide for a further means of adjusting the height of the armboard as it is then possible to slide the attaching socket along the rail to a lower or higher position, while still maintaining the armboard beneath the patient's arm.

While the angulation of the armboard to the table is adjustable by the armboard's own mechanism, all four of the other motions are possible to be varied, namely; 1. the position of the armboard along the length of the table; 2. the vertical inclination of the armboard; 3. the height of the armboard; and 4. the rotation of the armboard along its longitudinal axis. All such positions are adjustable at the socket device interface, and once selected, are all simultaneously and in a single step, secured by tightening the torque bar of the socket mechanism.

The shaft portion of the present invention has been deliberately extended beyond what is needed to simply engage the socket mechanism, so that the socket is not covered by the armboard, so that it is then possible to both see and easily access the socket mechanism.

OBJECTS OF THE PRESENT INVENTION

It is an object of the present invention to provide for a surgical armboard attachment device that is safer;

It is another object of the present invention to provide for a surgical armboard attachment device that can be optimally positioned so as to avoid pressure, tension, or posterior displacement of the shoulder, which could result in injury to the underlying Brachial Plexus.

It is another object of the present invention to provide for a surgical armboard attachment device that is easier to use;

It is a purpose of the present invention to provide for a surgical armboard attachment device that is more economical;

These and other objects of the present invention will be apparent from a review of the following specification and accompanying drawings.

DETAILED DESCRIPTION OF THE DRAWINGS

Figure 1:
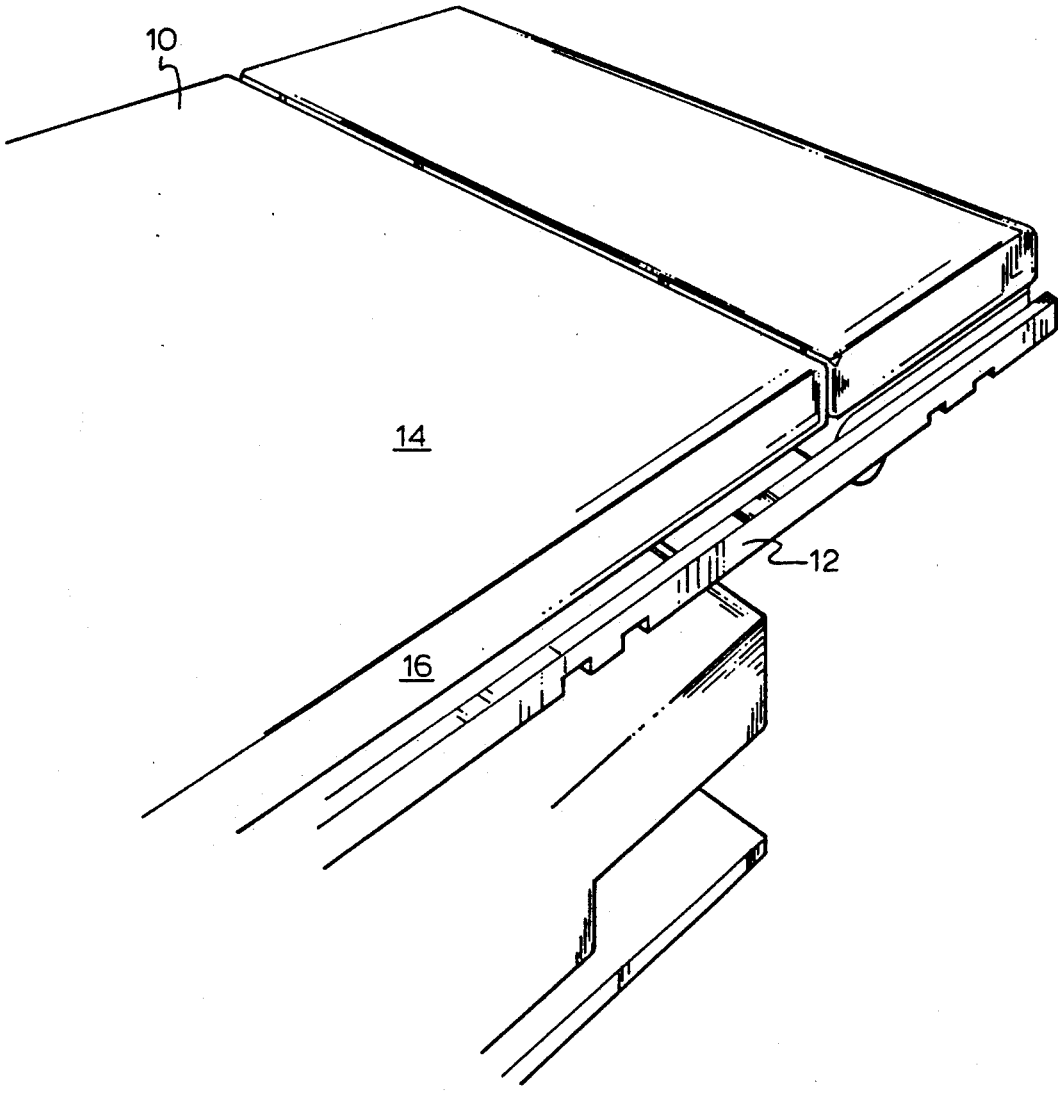
FIG. 1 is a perspective drawing of a portion of an operating table showing the side rail.
Figure 2A:
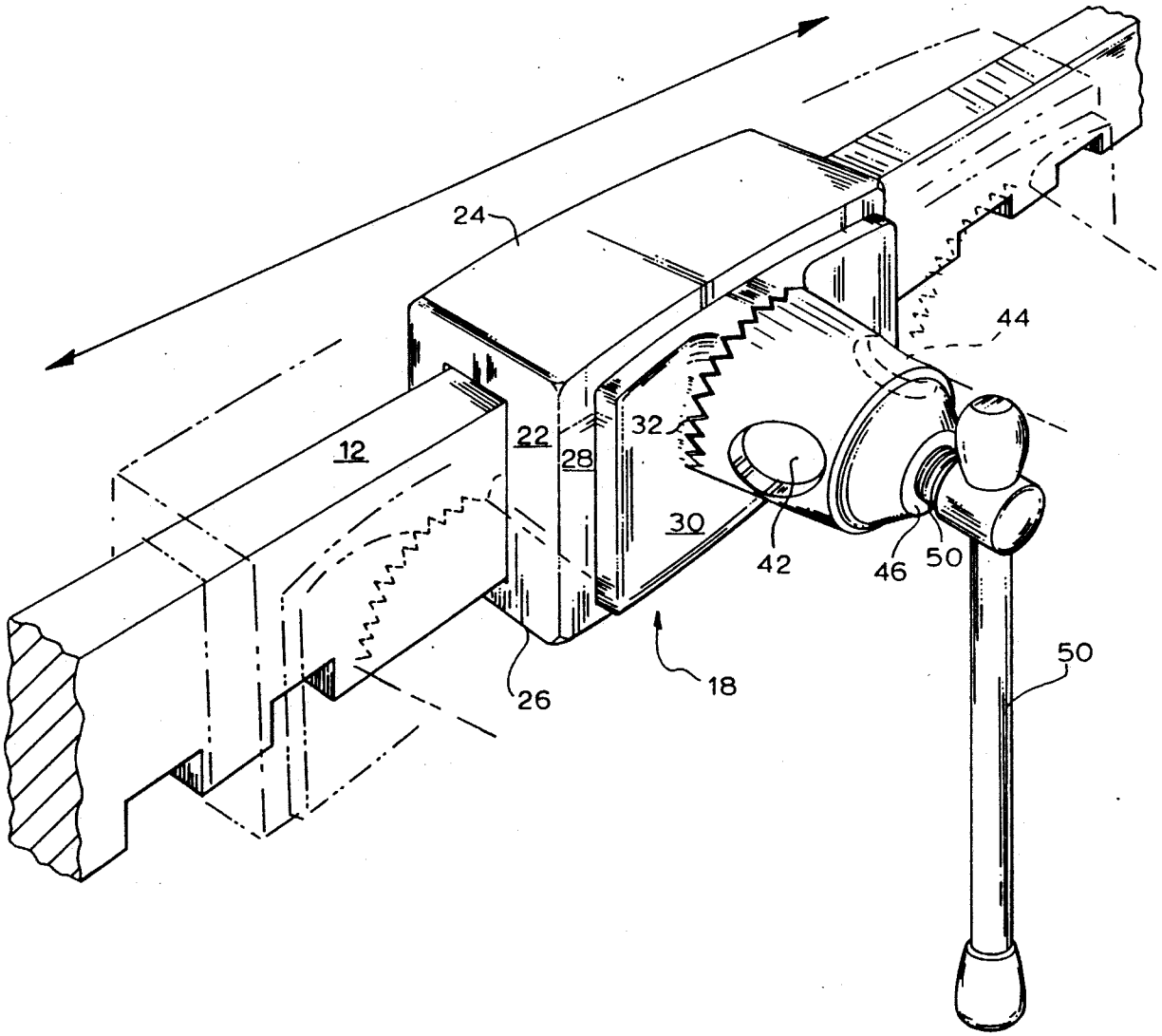
FIG. 2(A) (PRIOR ART)
FIG. 2a–2d is a perspective view of a conventional socket attached to the operating table side rail.
Figure 2B:
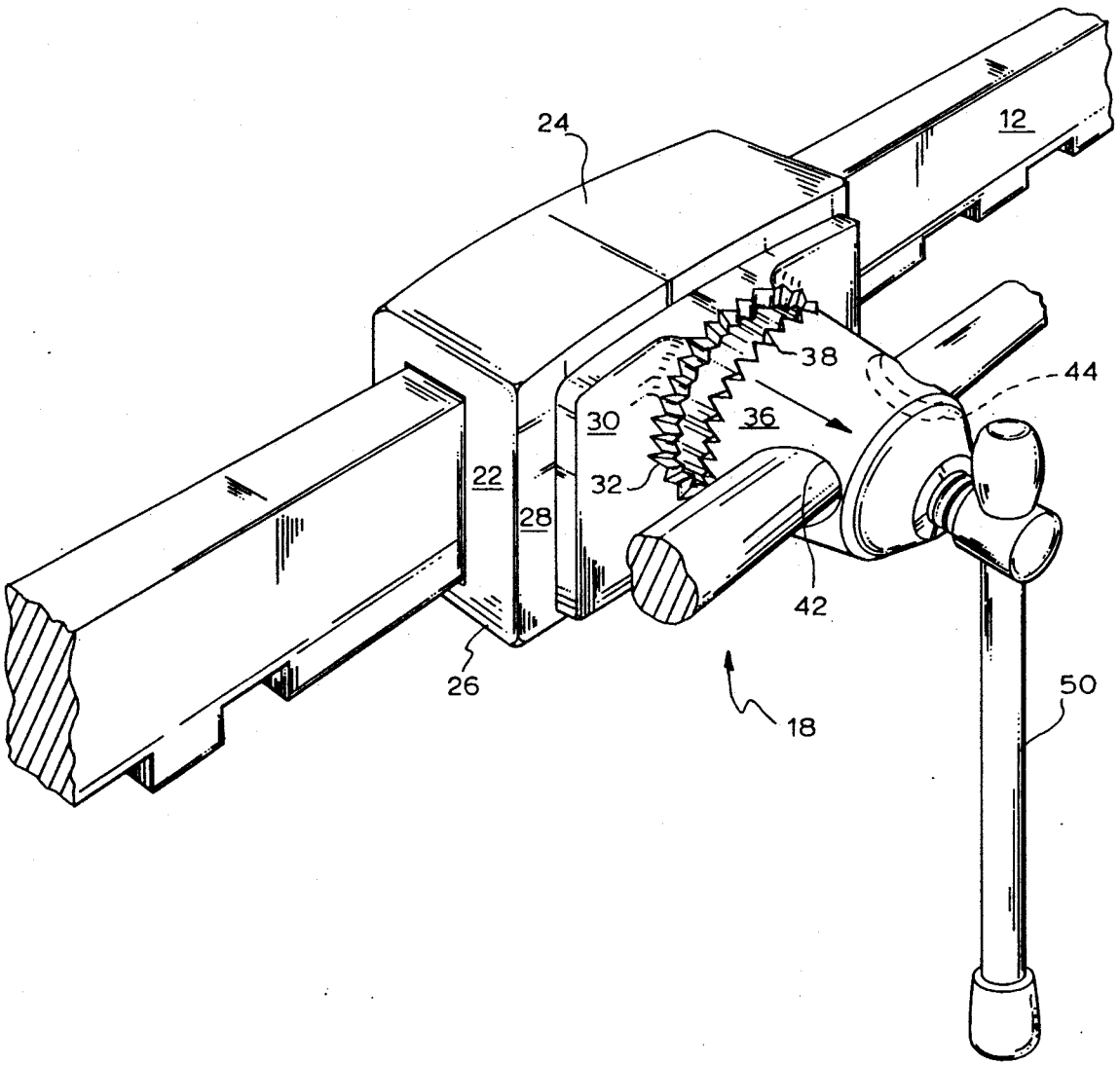
Figure 2D:
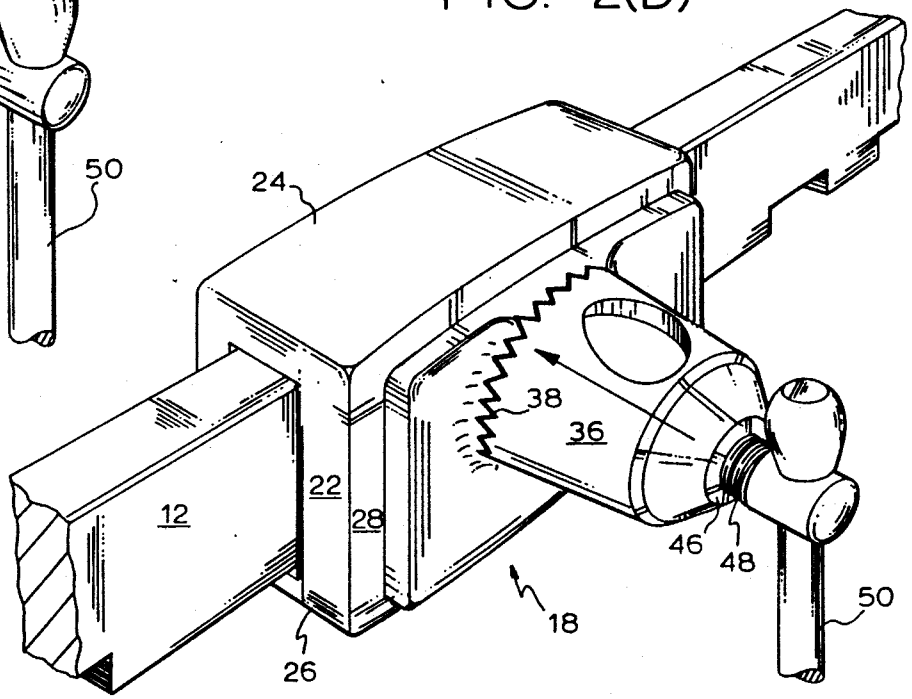
Figure 2C:
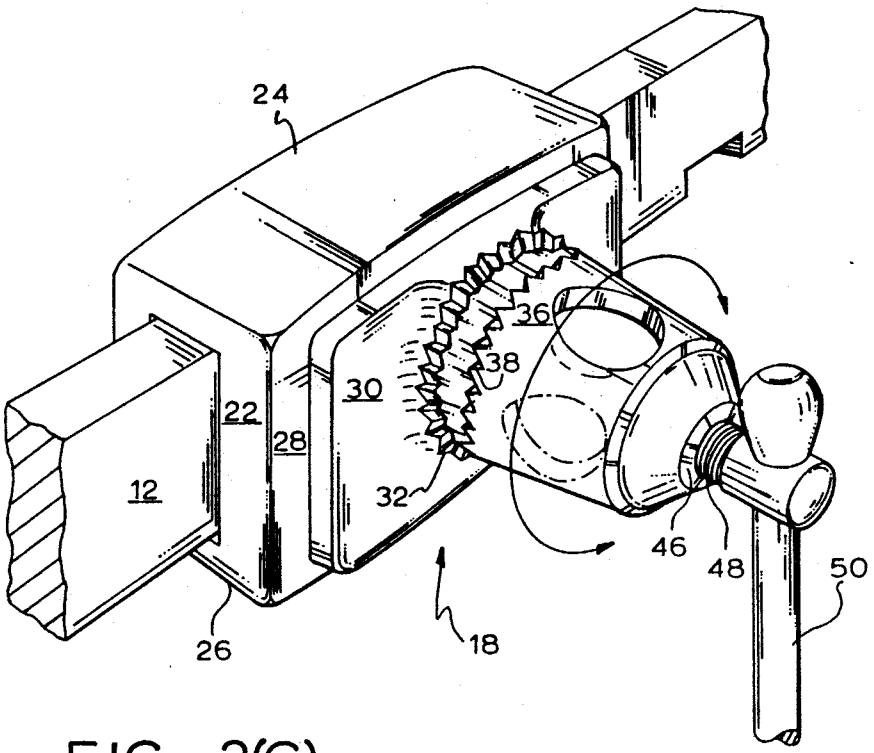

Referring to the drawings, the present invention will be described in detail. FIG. 1 shows a conventional operating room table 10 having a side rail 12. The side rail 12 extends slightly below the top surface 14 of the operating table 10 and away from the side 16 of the operating table 10 creating a space between the side rail 12 and the side of the operating table for attachment of the conventional socket mechanism 18 shown in FIGS. 2a–2d.

The conventional socket mechanism 18 consists of a U shaped member 22 having side arms 24 and 26 and a base portion 28. The side arms 24 and 26 complement the dimensions of the side rail 12 permitting sliding engagement of the socket mechanism 18 along the side rail 12.

The base portion 28 of the socket mechanism 18 has a flat plate 30 covering it which has a series of serrated projections 32 projecting perpendicularly to the flat plate 30. A complementary tubular member 36 has a complementary series of serrated projections 38 on the lower edge of the tubular member 36 for engaging the serrated projections 38 of the flat plate 30.

Two circular aligned openings 42 and 44 are formed in the side of the tubular member 36 for receipt of a shaft. The top surface of the tubular member 36 has a threaded opening 46 for receipt of a correspondingly threaded shaft 48 having a torque bar 50 slidable attached to the threaded shaft 48 for turning the threaded shaft 48. The threaded shaft 48 is sufficiently long so as to extend beyond the upper portion of the aligned openings 42 and 44.

The operation of the socket mechanism is shown in FIGS. 2a–2d. The tubular member 36 is capable of being lifted and rotated, provided the serrated projections 36 and 38 are not engaged. However, when the serrated projections 36 and 38 are engaged, rotation of the tubular member 36 is not possible.

Figure 3:
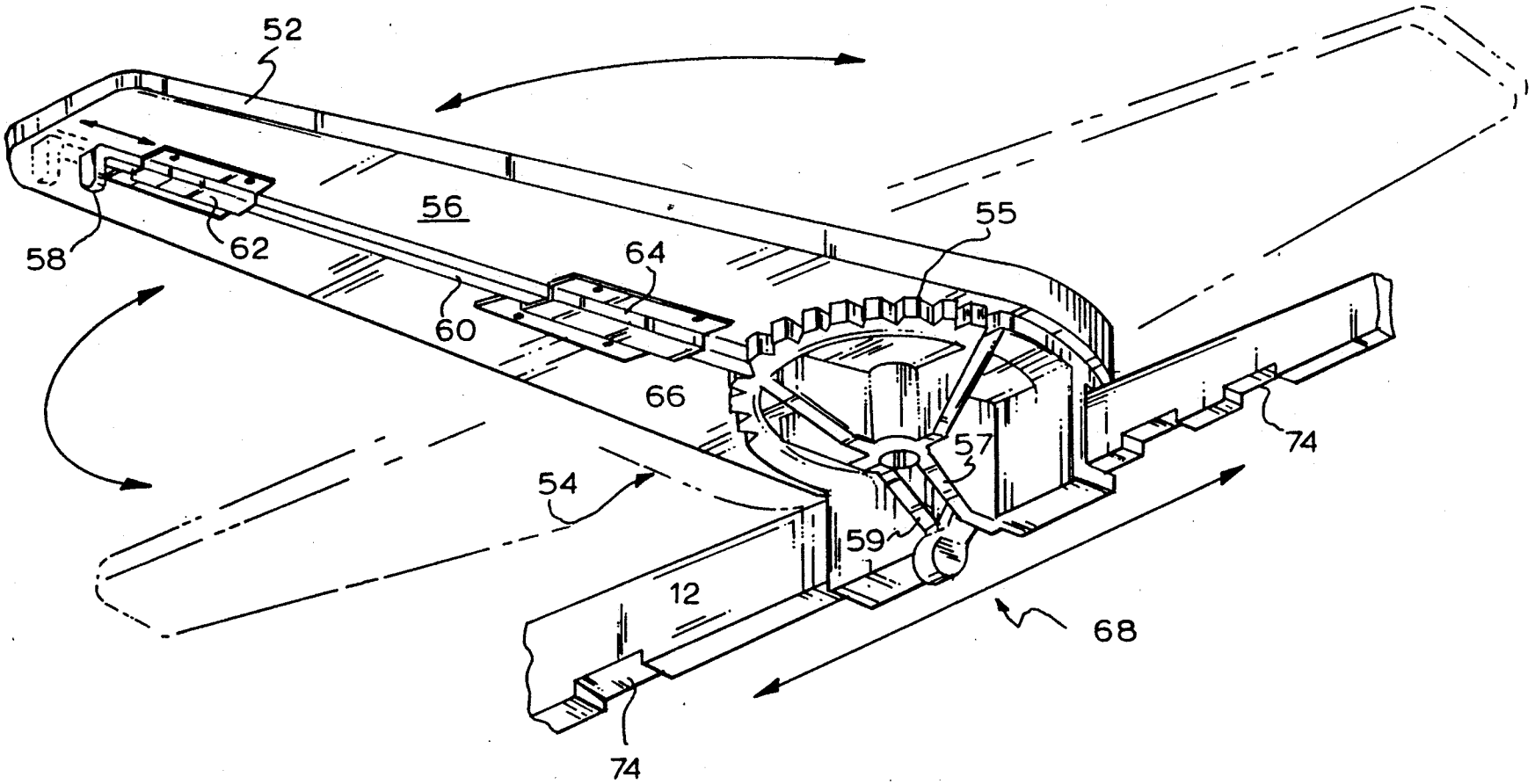
FIG. 3 is a perspective bottom view of a conventional surgical armboard showing the gear configuration by which the angle of the board may be adjusted within the surface plane of the operating table.

Referring to FIG. 3, the bottom of the conventional arm board 52 is shown attached directly to the side rail 12. The armboard 52 is a generally planar member, longer than it is wide, having a gear configuration 54 mounted at one end on the bottom surface 56 of the armboard 52. The gear configuration 54 is rotatably mounted to the armboard 52, permitting it to rotate about its central axis relative to the arm board 52.

Mounted to the arm board 52 is a sliding lock mechanism 58 for engaging the gear configuration 54 to prevent relative movement of the gear 55. The sliding lock mechanism 58 consists of a bar 60 slidably attached to the bottom surface 56 of the armboard 52 by U clamps 62 and 64. Pulling the bar 60 away from the gear 55 permits movement of the gear configuration 54, while pushing the bar 60 forward causes the tip 66 of the bar 60 to engage the gears 55.

Integrally attached to the gear configuration 54 is the side rail attachment assembly 68. The side rail attachment assembly 68 consists of a U shaped member 70 having a lip 73 for slidably engaging the side rail 12 of the operating table 10.

Figure 7:
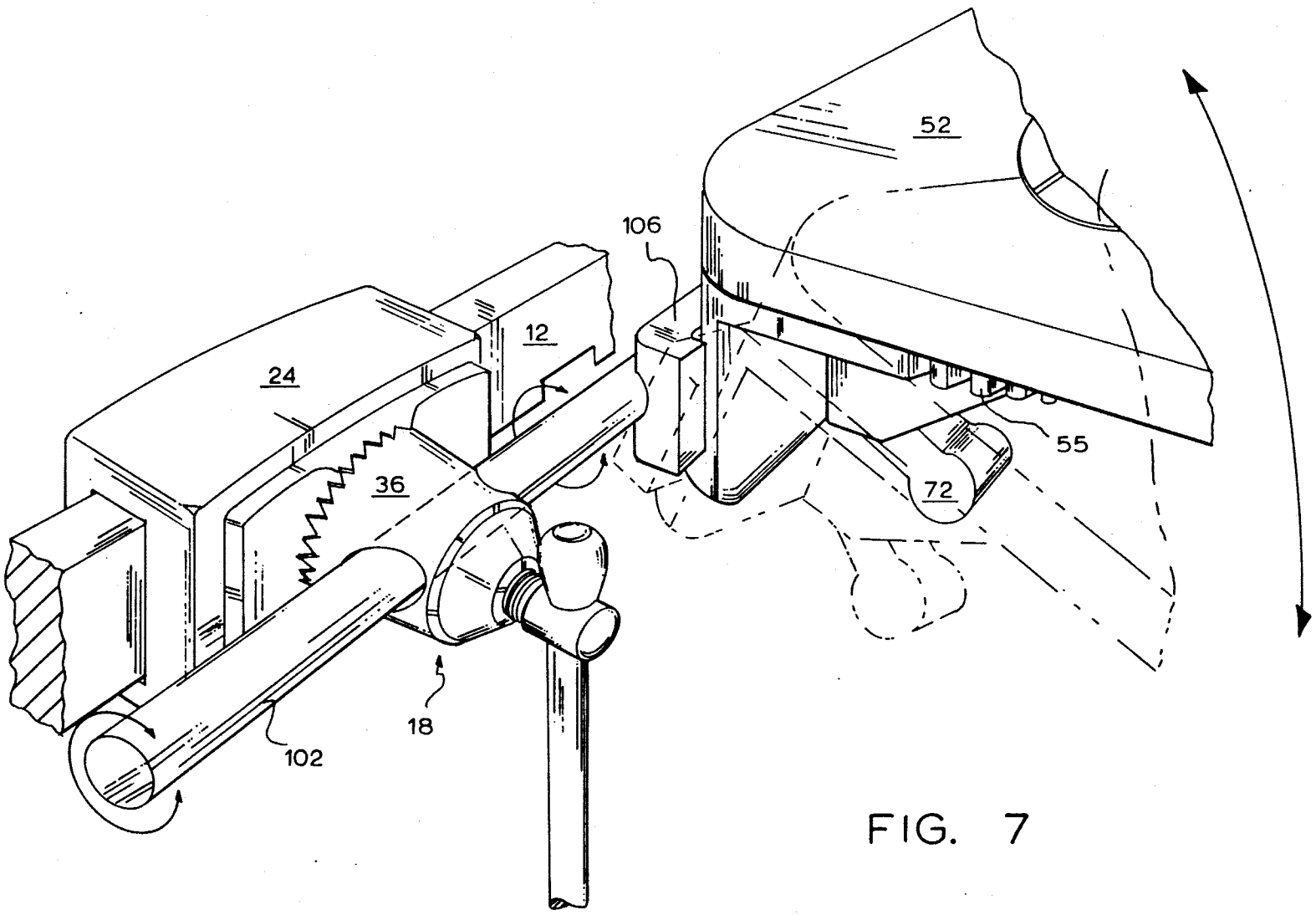
FIG. 7 is a perspective view showing the attachment device attached to the armboard and the socket mechanism.

As shown in FIG. 7, a lock pin 72, pivotably about pin 71, located between supports struts 57 and 59, is associated with the U member 70 for engaging slots 74 in the side rail 12 to prevent movement of the armboard 52 in relation to the operating table 10.

In use, the conventional armboard 52 is attached to the side rail 12 of the operating table 10. The armboard 52 is moved to the desired position and the lock pin 72 pivoted so that its forward end 73 fits within the slot 74 in the side rail 12. The bar 60 is then pulled rearwardly and the armboard 52 rotated to the desired position. The bar 60 is then pushed in to have its tip 66 engage the gear 55.

Figure 4:
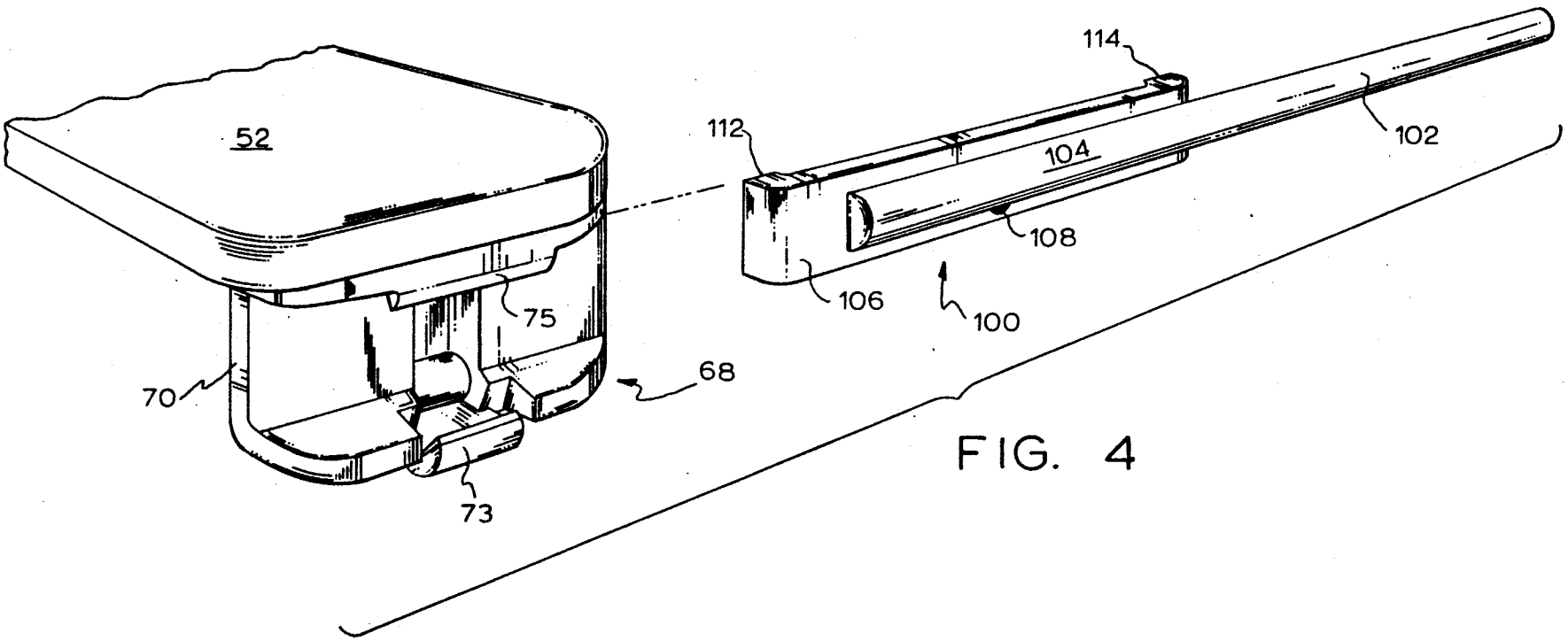
FIG. 4 is a perspective view of the armboard attachment device separated from the armboard.
Figure 5:
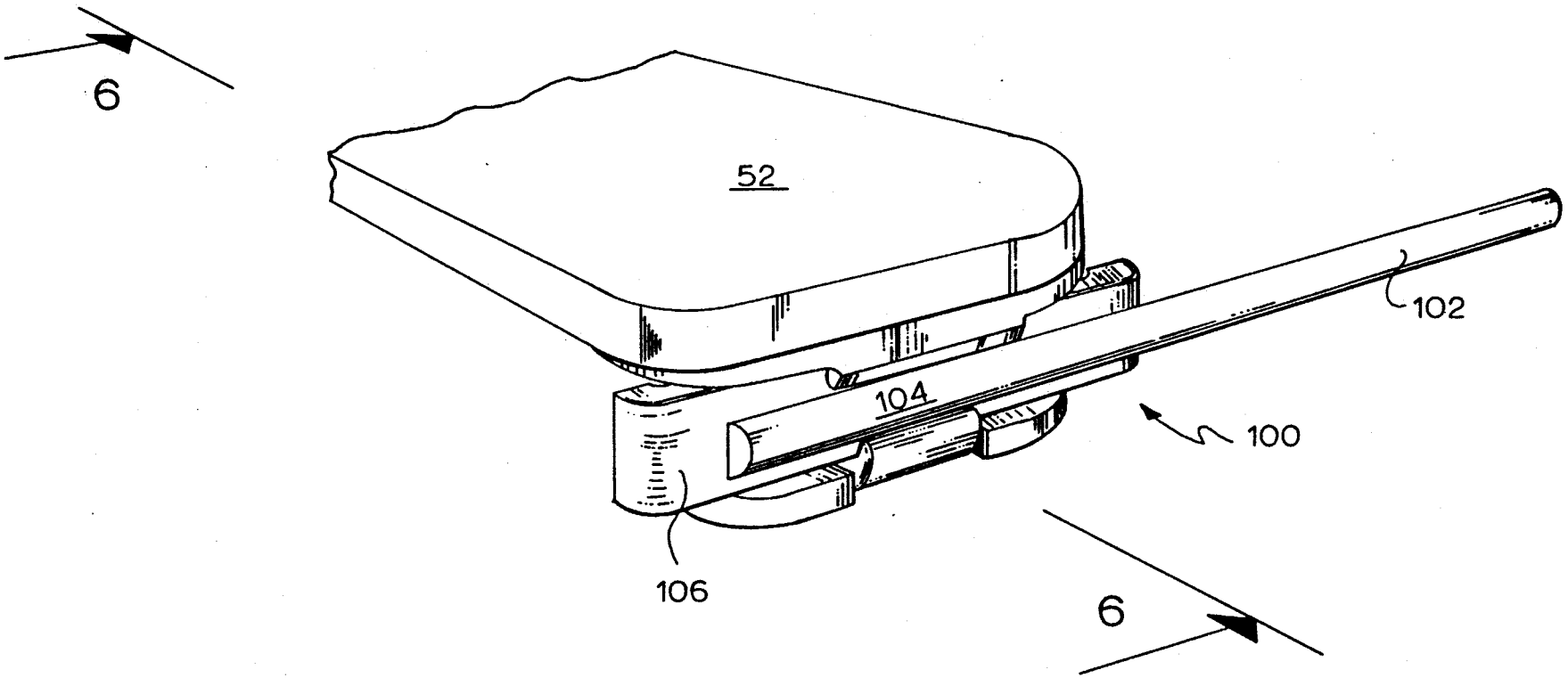
FIG. 5 is a perspective view of the adaptor device attached to the conventional armboard.

Referring to FIGS. 4 and 5 the attachment device 100 of the present invention is shown for use with the conventional armboard 52. The armboard 52 is shown in an end perspective view. The attachment device 100 consists of a shaft 102 mounted along a portion of one end 104 to a rectangular member 106. The shaft 102 may be mounted to the rectangular member 106 by any of a number of conventional means, including mounting by bolts or welding. The rectangular member 106 has a height approximately the width of the space between the arms of U member 70 and a width slightly less than the length of the arm of the U member 70.

The rectangular member 106 has a threaded hole 108 for receiving a correspondingly threaded screw 100. The rectangular member 106 is attached to the armboard 52 by fitting the rectangular member 106 within the arms of the U member 70 and beneath the lip 75. The lock pin 72 is then lifted to prevent the rectangular member 106 from being removed. The rectangular member 106 has projections 112 and 114 at its ends for preventing movement of the rectangular member longitudinally within the U member 70.

Figure 6:
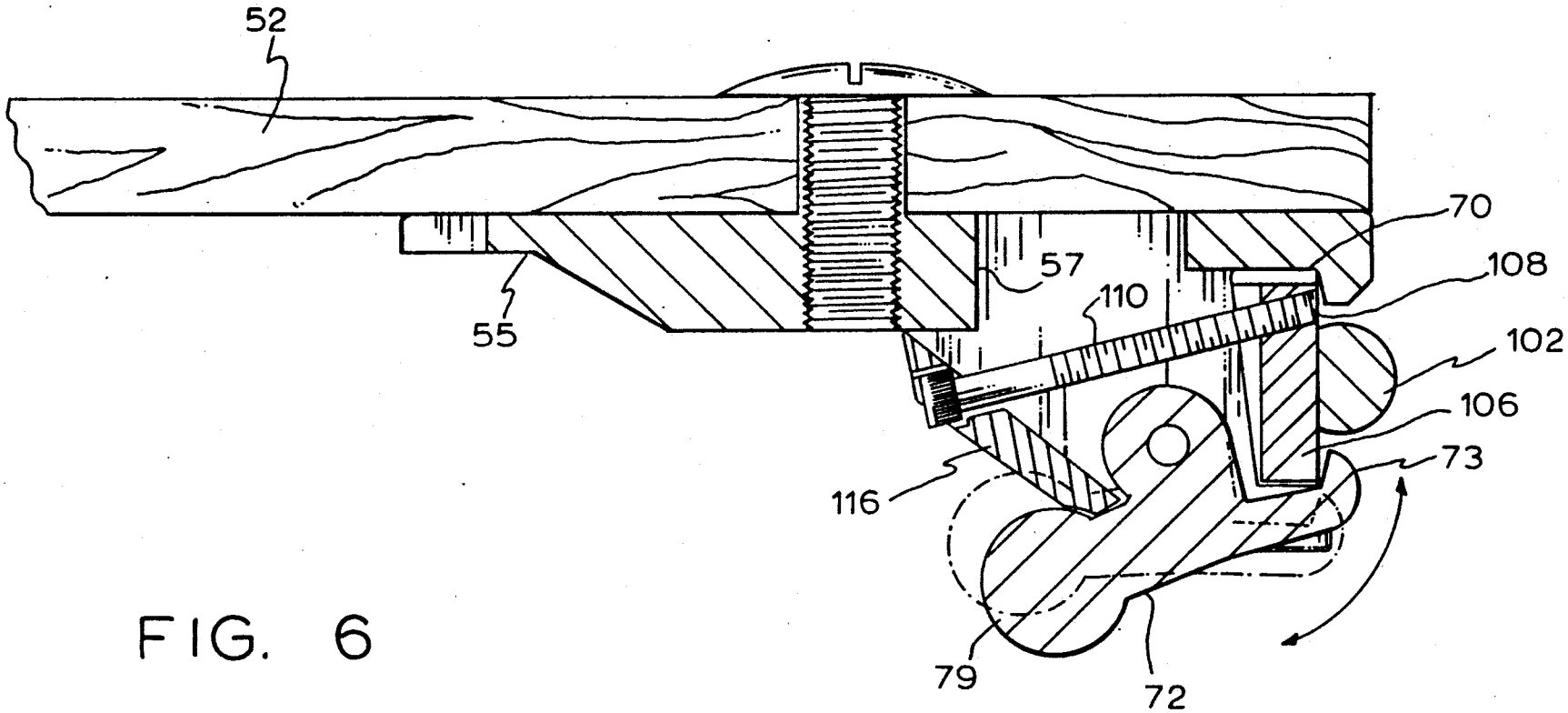
FIG. 6 is a side sectional view of the adaptor device secured by the nut block to the armboard with the lock pin mechanism engaged.

Referring to FIG. 6 the means of locking the attachment device 100 to the armboard 52 is shown. The lock pin 72 is shown having its lower edge 73 abutting the rectangular member 106 of the attachment device 100. A screw 110 is passed through a plate 116 that sits on the top support struts 57 and 59. The screw 110 enters the hole 108 in the rectangular member 106 holding the plate 116 in on the support struts 57 and 59, place preventing the opposite end 79 of the lock pin 72 from pivoting so as to disengage from the rectangular member 106.

Figure 8:
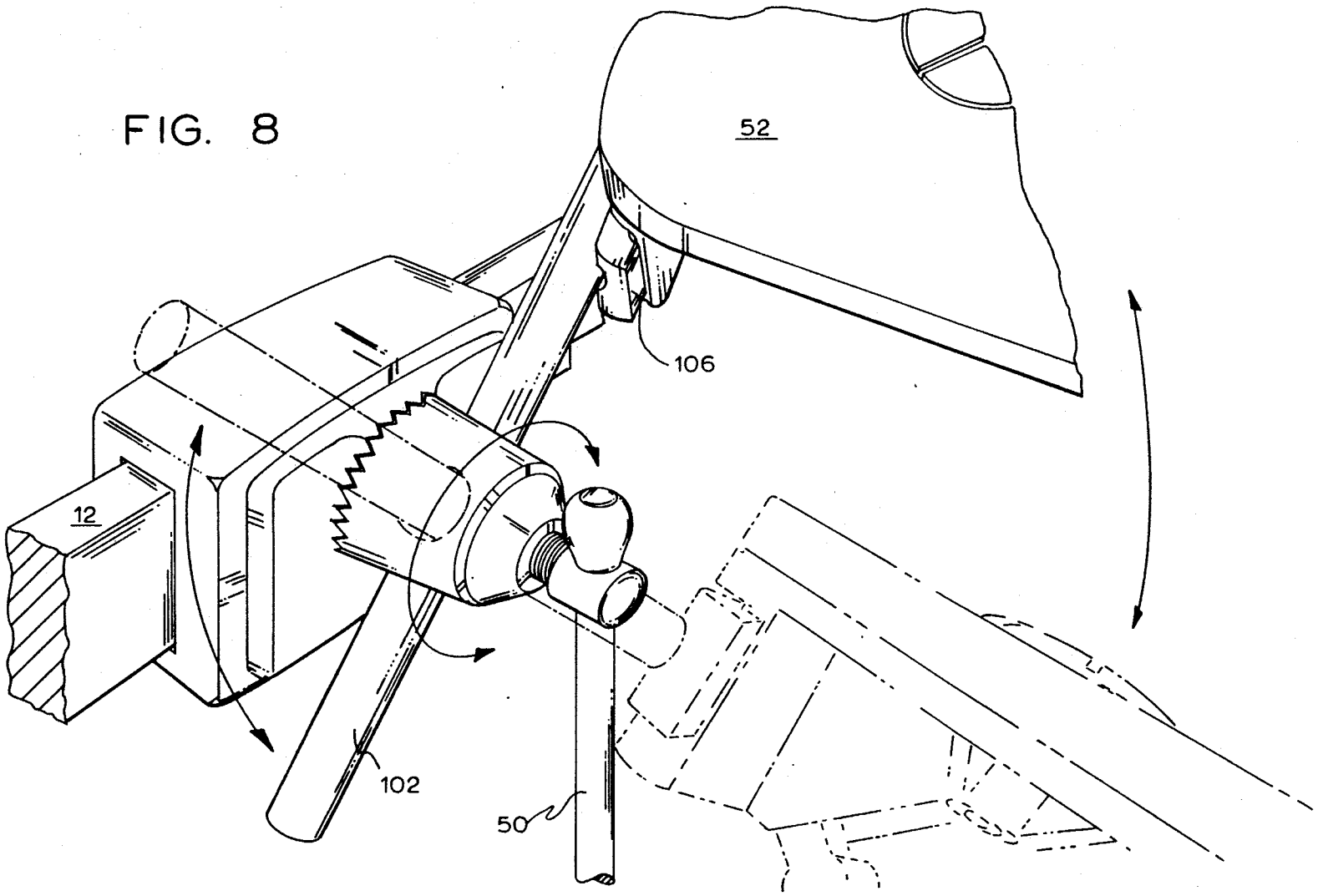
FIG. 8–9 are perspective views of alternative embodiments of the present invention showing an intregal attachment design.

Referring to FIGS. 7 and 8 the attachment device is shown attached to an armboard 52 and fitted within a socket mechanism 18 attached to the side rail 12 of the operating table 10.

As can be seen, the shaft 102 of the attachment device 100 is fitted within the aligned openings 42 and 44 of the socket mechanism 18. The torque bar 50 is then rotated until the threaded shaft 48 impinges upon the shaft 102, locking it in place. As can be seen the shaft 102 can be rotated about its central axis, thereby permitting the armboard to be rotated. Additionally, rather than move the socket mechanism 18 to move the armboard 52 along the side rail 12, it is possible to move the shaft 102 within the socket mechanism 18.

Additionally, as shown in FIG. 8, the torque bar 50 can be rotated so as to permit the serrated projections 32 and 38 to disengage so that the arm board 52 can be rotated in a plane perpendicular to the plane of the top surface 14 of the operating table 10.

In the preferred embodiment, the rectangular member 106 is approximately 5 inches long, ⅜ inches wide and about 1⅛ inches high. The side rail of a conventional operating table is also about 1/18 inches high. The shaft 102 extends approximately 5½ inches beyond the end of the rectangular member 106. The attachment device is preferably made out of steal, but can be made out of any suitable unbendable material, including high impact plastics.

Figure 9:
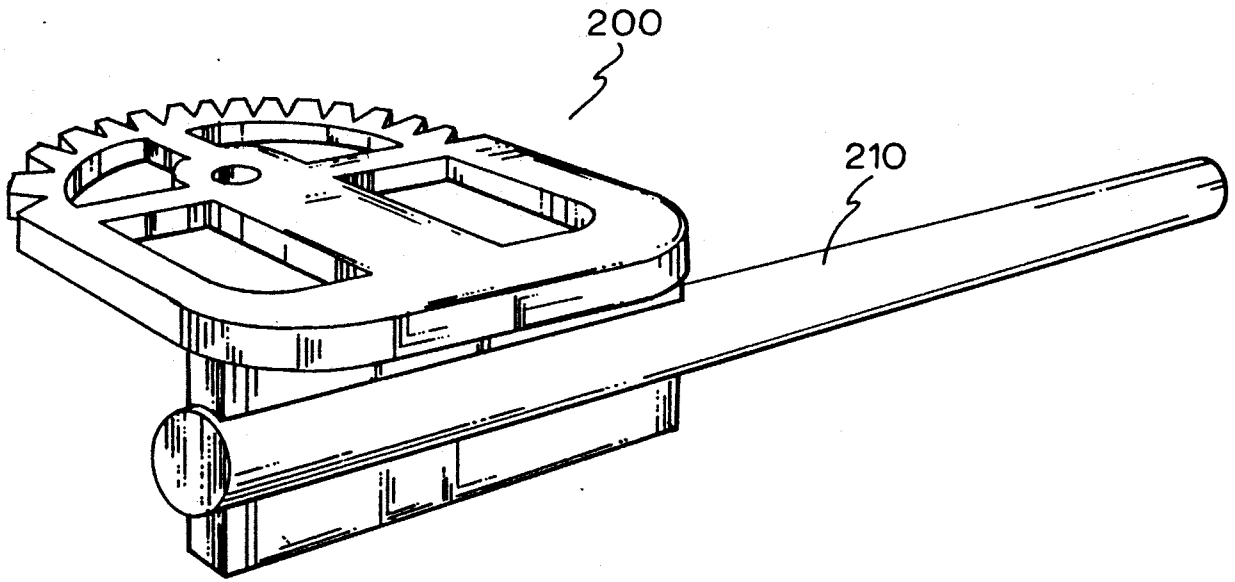

While the present invention has been described in association with an attachment device that can be used with an existing armboard by using a conventional socket, it is also possible to form the attachment device integrally to an armboard, such as shown in FIG. 9. In FIG. 9 the gear mechanism 200 and the shaft 210 are formed integrally so that there is no need to simulate a side rail. The shaft is integrally attached to the armboard and the shaft is then fitted within the openings of a conventional socket mechanism.

While the conventional armboard is designed to mate with a rectangular attachment device, it is recognized that the shape of the attachment device can be varied to accommodate the configuration of the portion of the armboard that attaches to the side rail.

Additionally, while the conventional socket mechanism is designed to receive a tubular rod, the shape of the shaft of the attachment device can be changed to accommodate the shape of the socket mechanism. For example, if the socket mechanism is designed to receive a regular polygon shaped shaft, the shaft of the attachment device would be a regular polygon.

These and other configurations can be made without departing from the concept of the present invention.

What is claimed is:

1. An attachment device for attachment to a medical arm board, said arm board having an attachment device for attachment to the side rails of an operating table, said attachment device comprising a rectangular member having the approximate width and thickness of the side rail of an operating table, said rectangular member having a tubular shaft extending therefrom along the longitudinal plane of the rectangular member.

2. The attachment device of claim 1 in which said rectangular member has a threaded opening for receiving a screw.

3. The attachment device of claim 2 in which said rectangular member has a projection from at least one end thereof.

4. The attachment device of claim 1 in which the shaft extends beyond the end of the rectangular member.

5. The attachment device of claim 4 including a lock means for locking said attachment device to said arm board.

6. The attachment device of claim 5 in which said lock means comprises a screw and plate, said screw engaging the hole in the rectangular plate, said plate slidably engaging the lock pin of an armboard to prevent rotation of said lock pin.

7. An armboard comprising an arm rest portion, said arm rest portion having a top surface and a tubular shaft attached to said arm board, the axis of said tubular shaft being parallel to the plane of said top surface along the entire length of said tubular shaft in which said arm rest portion has a gear mechanism for permitting the rotation of the arm rest portions in its own plane.

8. The arm board of claim 7 in which said shaft is adapted to engage a socket mechanism removably attachable to an operating table.

9. An attachment device for attachment to a medical armboard comprising first attaching means for removable attaching said device to the armboard and second attaching means for fitting said device within a socket mechanism permitting three degrees of freedom of movement, said first attaching means connected to said second attaching means in which said first attaching means comprises a member having a portion which stimulates a side rail of a hospital operating table.

10. The attachment device of claim 9 in which said first attaching means is integrally attached to said second attaching means and said second attaching means comprises a tubular shaft, said tubular shaft capable of engagement with a socket mechanism.

11. An attachment device for attachment to a medical armboard comprising first attaching means for removably attaching said device to the armboard and second attaching means for attaching said device to a socket mechanism, said first attaching means connected to said second attaching means, in which first attaching means comprises a member having a portion which simulates a side rail of a hospital operating table, and in which said second attaching means comprises a tubular shaft, said tubular shaft capable of engagement with a socket mechanism.

12. The attachment of claim 11 in which said first attachment means in integrally attached to said second attaching means.

13. An attachment device for attachment to a medical armboard comprising first attaching means for removably attaching said device to the armboard and second attaching means for attaching said device to a socket mechanism in which said first attaching means comprises a member having a portion which simulates a side rail of a hospital operating table, said second attaching means comprises a tubular shaft, said shaft capable of engagement with a socket mechanism.

* * * * *